US006250937B1

(12) United States Patent
Okabe et al.

(10) Patent No.: US 6,250,937 B1
(45) Date of Patent: Jun. 26, 2001

(54) LEVER FITTING-TYPE CONNECTOR

(75) Inventors: Toshiaki Okabe; Tetsuya Yamashita, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/392,782

(22) Filed: Sep. 9, 1999

(30) Foreign Application Priority Data

Feb. 8, 1999 (JP) ..... 11-030515

(51) Int. Cl.[7] ..... H01K 13/62
(52) U.S. Cl. ..... 439/157; 439/372
(58) Field of Search ..... 439/157, 152, 439/160, 155, 372, 153

(56) References Cited

U.S. PATENT DOCUMENTS 5,829,994 * 11/1998 Oda et al. ..... 439/157
5,971,779 * 10/1999 Okabe ..... 439/157
5,980,283 * 11/1999 Okabe ..... 439/157
6,019,620 * 2/2000 Kodama et al. ..... 439/157
6,056,582 * 5/2000 Okabe ..... 439/372

FOREIGN PATENT DOCUMENTS 94 11 509 A1 11/1994 (DE) .
199 36 310 A1 2/2000 (DE) .
199 36 871 A1 3/2000 (DE) .

* cited by examiner

*Primary Examiner*—Gary F. Paumen
*Assistant Examiner*—Ross Gushi
(74) *Attorney, Agent, or Firm*—Sughrue, Mion, Zinn, Macpeak & Seas, PLLC

(57) ABSTRACT

A lever 22 is pivotally supported on a male connector 21 by bosses 27, and an engagement projection 30 is formed on a lower portion of each of opposite side walls 28 of the lever 22 at a front end portion thereof. The engagement projection 30 is formed on such an area of the side wall 28 of the lever 22 that the amount of movement of the engagement projection 30 in a generally-horizontal direction in accordance with the pivotal movement of the lever is larger than the amount of movement of the other end of the lever in a generally-horizontal direction. Therefore, the amount of engagement of the engagement projection 30 into the engagement groove 35 is large, and therefore even if the lever 22, incompletely engaged in the guide grooves 34, is pivotally moved, the lever 22 can not be pivotally moved further, and hence an uninterrupted movement of the lever 22 will not occur, thereby preventing a half-fitted condition of the male connector 21.

2 Claims, 7 Drawing Sheets

LEVER FITTING-TYPE CONNECTOR

BACKGROUND OF INVENTION

1. Field of Invention

This invention relates to a lever fitting-type connector in which a connector is fitted into a mating connector by pivotally moving a lever mounted on the connector.

2. Related Art

FIG. 6 shows a conventional lever fitting-type connector. This lever fitting-type connector comprises a male connector 1, a lever 2 pivotally mounted on the male connector 1, and a female connector 3 into which the male connector 1 is fitted.

The male connector 1 has a plurality of terminal receiving chambers 4 for respectively receiving terminals therein, which terminal receiving chambers 4 extend through the male connector 1 in an upward-downward direction. Disengagement prevention ribs 6 are respectively formed on and project laterally from opposite side surfaces 5 of the male connector 1 at one end thereof, and extend in a connector-fitting direction. A slot 7 is formed between each of the disengagement prevention ribs 6 and the corresponding side surface 5, the slots 7 extending in the connector-fitting direction. Bosses 8 are also formed on and project from the opposite side surfaces 5 of the male connector 1, respectively.

Each boss 8 is disposed generally centrally of the length of the male connector 1. The lever 2 is pivotally supported by these bosses 8.

The lever 2 includes a pair of right and left side walls 9, and an operating portion 10 interconnecting the right and left side walls 9. The right and left side walls 9 have rotation holes 11, respectively, in which the bosses 8 are inserted, respectively, so that the lever 2 can be pivotally moved about the bosses 8.

The operating portion 10 of the lever 2 interconnects the rear end portions of the right and left side walls 9, and this operating portion 10 is operated or pressed when fitting the connector. Front end portions of the right and left side walls 9 remote from the operating portion 10 serve as projected engagement portions 12, respectively. These projected engagement portions 12 are inserted respectively in the slots 7 in the male connector 1, and therefore will not be disengaged respectively from the disengagement prevention ribs 6, so that the lever 2 is prevented from being disengaged from the male connector 1.

The female connector 3 includes a hood portion 13 with an open top into which the male connector 1 is fitted. Engagement holes 15, in which the projected engagement portions 12 can be engaged, respectively, are formed in that surface 14 of the hood portion 13 which is to be opposed to the projected engagement portions 12. Elongate grooves 16 for respectively receiving the disengagement prevention ribs 6 of the male connector 1 are formed respectively in opposite side surfaces of the hood portion 13.

In this lever fitting-type connector, the lever 2 is mounted on the male connector 1, as shown in FIG. 6, and the male connector and the lever in this assembled condition are inserted into the hood portion 13, thus effecting the fitting operation. At this time, the disengagement prevention ribs 6 are inserted respectively into the elongate grooves 16, and by doing so, the gouging engagement between the connectors 1 and 3 can be prevented.

For fitting the connectors together, the projected engagement portions 12 of the lever 2, are passed respectively through the slots 7 in the male connector 1, and are engaged respectively in the engagement holes 15 in the hood portion 13, and in this engaged condition, the operating portion 10 is pressed. In this pressing operation, the operating portion 10 serves as a force-applying point, and the bosses 8 serve as an application point, and the projected engagement portions 12, engaged respectively in the engagement holes 15, serve as a supporting point. In this operation, the lever 2 is pivotally moved, and therefore the lever 2 and the male connector 1 are fitted in unison into the female connector 3.

However, the male connector 1, together with the lever 2, is fitted in the hood portion 13 of the female connector 3, and in this condition, when the operating portion 10 is pressed to pivotally move the lever 2 through an angle a as shown in FIG. 7, the distal ends of the projected engagement portions 12 are projected a distance D in the direction of the length of the male connector 1 in accordance with this pivotal movement. However, the distance D of projecting of the projected engagement portions 12 is small though the operating angle is large. Therefore, when the lever 2 is pivotally moved by pressing the operating portion 10, with the male connector 1 fitted in the hood portion 13 of the female connector 3 in a shallow manner, the distal end of each projected engagement portion 12 fails to be brought into engagement with an upper end 15A of the associated engagement hole 15 since the amount of projecting of the distal end of the projected engagement portion 12 is small, and as a result the projected engagement portion 12 is moved into a position (indicated in a dot-and-dash line in FIG. 7). At this time, there is a possibility that the operator judges that the fitting operation is completed although the male connector 1 is actually half fitted in the hood portion 13. Particularly, in order to secure a sufficient engagement amount of the projected engagement portions 12, the amount of operation of the lever 2 must be set to a value larger than that required for the fitting of the terminals. This has resulted in a problem that the lever-operating angle a is increased.

SUMMARY OF INVENTION

It is an object of this invention to provide a lever fitting-type connector in which the fitting operation can be positively effected with a small operating angle, and an uninterrupted movement of a lever in a half-fitted condition is prevented.

The above object has been achieved a lever fitting-type connector of the present invention wherein a lever is pivotally supported on a connector intermediate opposite ends thereof, and an operating portion, formed at one end portion of the lever, is pressed to pivotally move the lever while using the pivotally-supporting portion as an application point, thereby fitting the connector generally vertically into a mating connector; provided in that engagement projections are formed on and project laterally from opposite side surfaces of the lever, respectively, and each of the engagement projections is formed on such an area of the associated side surface of the lever that the amount of movement of the engagement projection in a generally-horizontal direction in accordance with the pivotal movement of the lever is larger than the amount of movement of the other end of the lever in a generally-horizontal direction; and guide grooves for respectively fitting on the engagement projections so as to guide them in a generally-vertical direction are formed respectively in opposite inner surfaces of the mating connector; and engagement grooves are formed respectively in the opposite inner surfaces of the mating connector, and communicate directly with the guide grooves, respectively, and each of the engagement grooves has an engagement surface with which the associated engagement projection is brought into sliding engagement when fitting the connector into the mating connector by pivotally moving the lever, so that the engagement surface serves as a supporting point.

Thus, in this invention, each engagement projection is formed on such an area of the side surface of the lever that the amount of movement of the engagement projection in a generally-horizontal direction in accordance with the pivotal movement of the lever is larger than the amount of movement of the other end of the lever in a generally-horizontal direction. Therefore, if the lever is pivotally moved, with the connector half fitted in the mating connector, the inner surface of the guide groove prevents the movement of the engagement projection since the amount of movement of the engagement projection in the horizontal direction (that is, an engagement amount) is large. Namely, in a half-fitted condition of the connectors, even if the lever is operated to be pivotally moved, an interrupted movement of the lever will not occur, and the operating portion of the lever can not be pressed further, so that the operator can easily recognize such a half-fitted condition.

In the lever fitting-type connector of the present invention, the distance between the engagement projection and the pivotally-supporting portion is shorter than the distance between the pivotally-supporting portion and the operating portion.

In the present invention, the distance between the pivotally-supporting portion and the operating portion is longer than the distance between the engagement projection and the pivotally-supporting portion, and with this arrangement, the connector can be easily fitted into the mating connector with a smaller force.

DETAILED DESCRIPTION OF PREFERRED EMBODIMENTS

Figure 1:
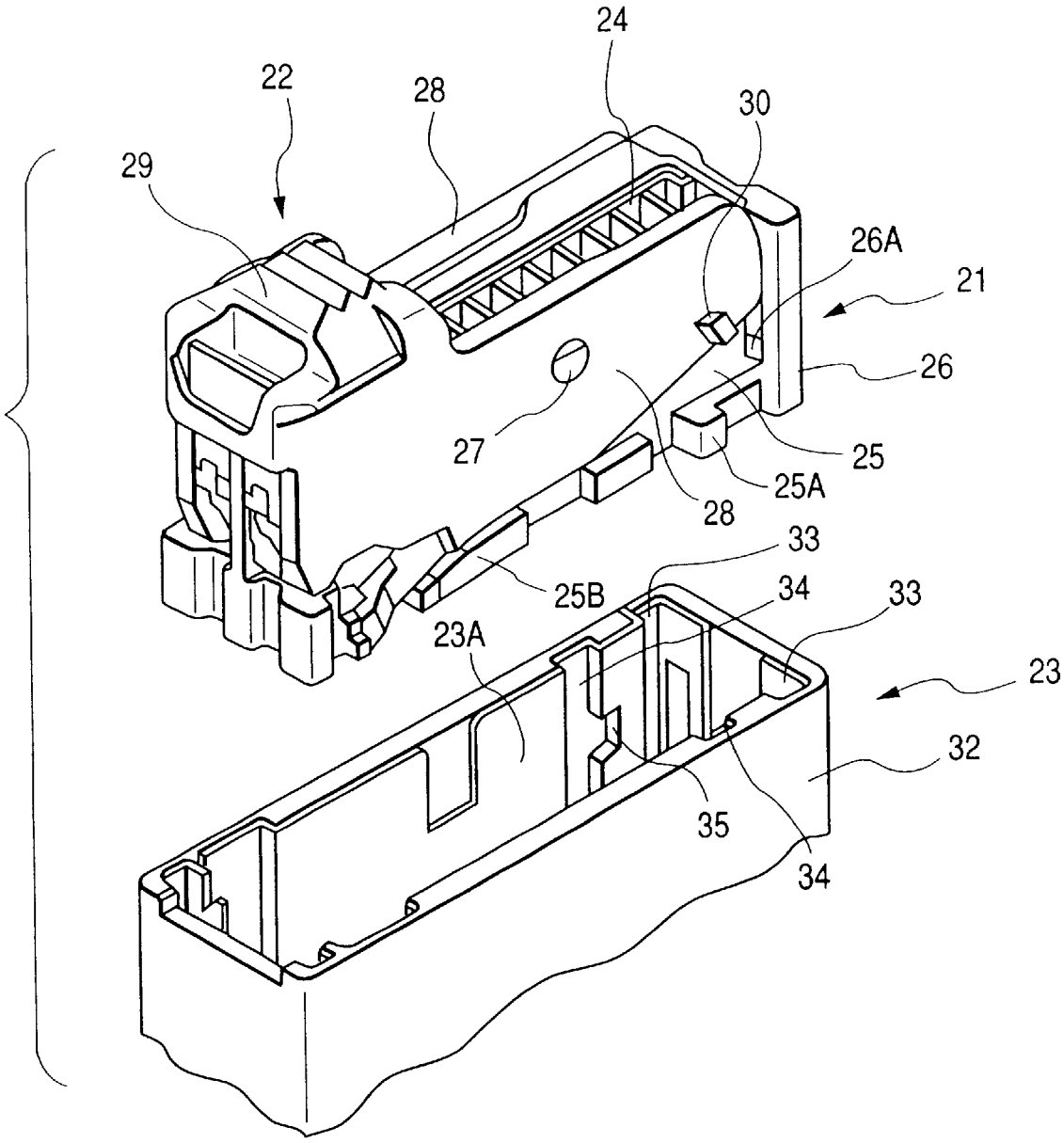
FIG. 1 is an exploded, perspective view of a preferred embodiment of a lever fitting-type connector of the present invention.

A preferred embodiment of a lever fitting-type connector of the present invention will now be described in detail with reference to the drawings. FIGS. 1 to 4 show the lever fitting-type connector of this embodiment.

This lever fitting-type connector comprises a male connector 21, a lever 22 pivotally mounted on the male connector 21, and a female connector 23 into which the male connector 21 is fitted.

The male connector 21 has a plurality of terminal receiving chambers 24 for respectively receiving terminals (which are connected respectively to connection terminals of the female connector 23 inserted into the male connector from a lower side thereof), and these terminal receiving chambers 24 extend through the male connector 21 in an upward-downward direction. Disengagement prevention ribs 26 are respectively formed on and project laterally from opposite side surfaces 25 of the male connector 21 at their one ends, these ribs 26 extending in a connector-fitting direction. Bosses 27, serving as rotation shafts, are formed on and project from the opposite side surfaces 25 of the male connector 21, respectively, and the lever 22 is pivotally supported by the bosses 27. Guide projections 25A are respectively formed on and project laterally from lower portions of the opposite side surfaces 25 of the male connector 21, and are disposed adjacent to the disengagement prevention ribs 26, respectively. These guide projections 25A serve to determine an initial condition of the lever 22, and are guided toward the female connector 23 in the fitting direction. Stopper blocks 25B for stopping the operation of the lever 22 are formed respectively on the lower portions of the opposite side surfaces 25 of the male connector 21 at rear end portions thereof, and these stopper blocks 25B project laterally respectively from the opposite side surfaces 25 by a distance generally equal to a wall thickness of the lever 22.

The lever 22 includes a pair of right and left side walls 28, and an operating portion 29 interconnecting rear end portions of the right and left side walls 28. The bosses 27 of the male connector 21 are inserted respectively in holes formed respectively through the right and left side walls 28, so that the lever 22 can be pivotally moved about the bosses 27. Projected portions 28A are formed respectively on front ends of the side walls 28 remote from the operating portion 29, and these projected portions 28A are inserted respectively in slots 26A for movement therealong, which slots 26A are formed respectively in the disengagement prevention ribs 26 of the male connector 21, and extend in the fitting direction. In this embodiment, an engagement projection 30 is formed on and projects laterally from each of the side walls 28, and is disposed between the projected portion 28A and the boss 27, and these engagement projections 30 serve as a supporting point for the pivotal movement of the lever.

Figure 2:
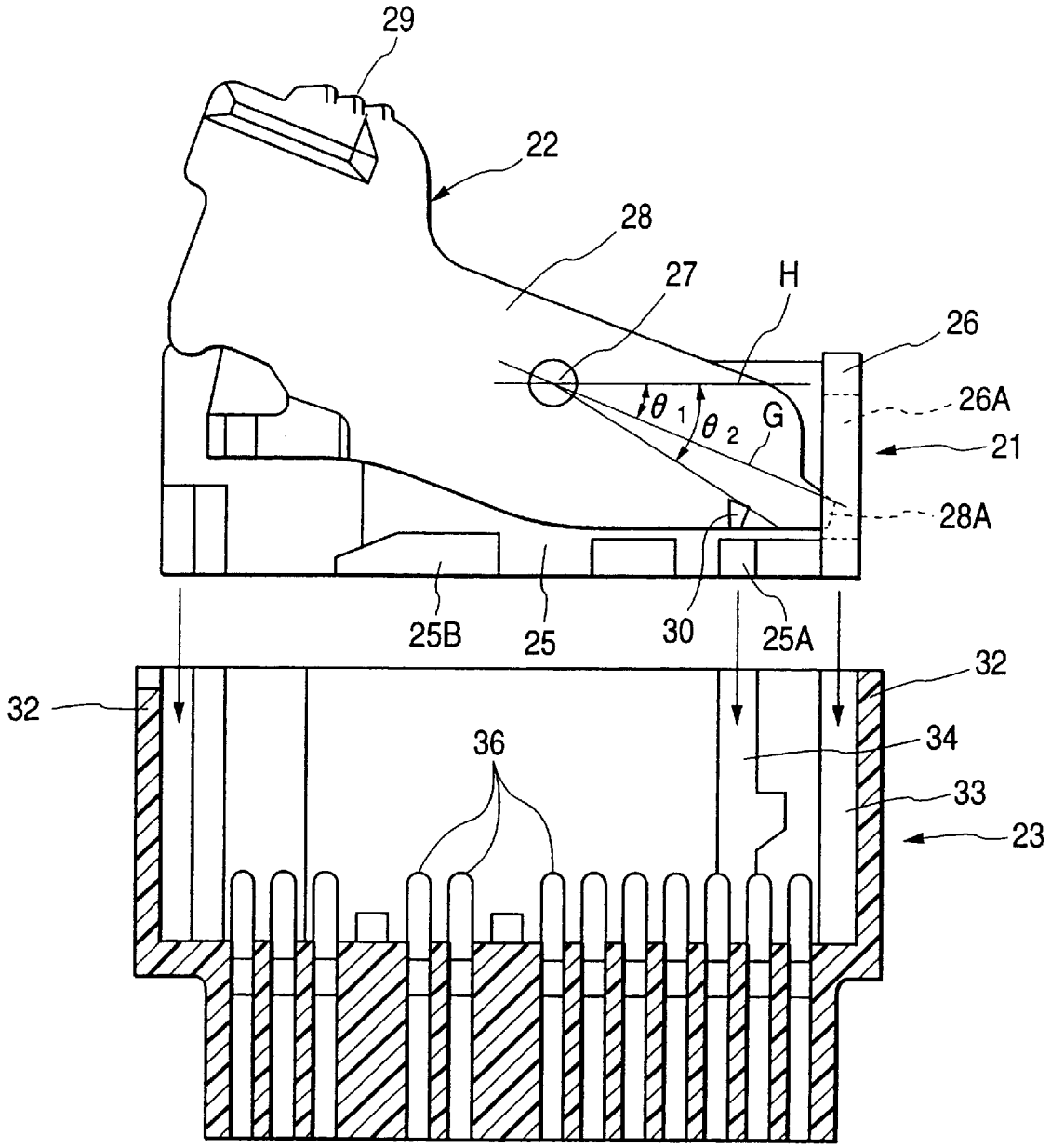
FIG. 2 is a partly cross-sectional, side-elevational view of the above embodiment, showing a condition before the connectors are fitted together.

As shown in FIG. 2, when the lever 22 is disposed in its initial condition (in which lower surfaces of the projected portions 28A of the lever 22 are abutted against the guide projections 25A, respectively), a line G, passing through the center of the boss 27 at each side wall 28 and the distal end of the projected portion 28A, is disposed at an angle of $\theta 1$ relative to a horizontal line H, and a line, passing through an engagement surface of the engagement projection 30 and the center of the boss 27, is disposed at an angle $\theta 2$ relative to the horizontal line H passing through the center of the boss 27. The engagement projection 30, while satisfying the above requirement, is formed between the boss 27 and the projected portion 28A, and is disposed closer to the projected portion 28A.

The female connector 23 has a hood portion 32 with an open top into which the male connector 21 is fitted. Elongate grooves 33 for respectively receiving the disengagement prevention ribs 26 of the male connector 21 are formed respectively in inner side surfaces 23A of the hood portion 32 at a front end portion thereof, and extend in the fitting direction (upward-downward direction). Guide grooves 34, corresponding respectively to the guide projections 25A formed respectively on the opposite side surfaces 25 of the male connector 21, are formed respectively in the inner side surfaces 23A of the hood portion 32, and extend in the fitting direction. An engagement groove 35 is formed in a front edge of the guide groove 34 intermediate opposite ends thereof, and hence communicates directly therewith, and projects forwardly from the guide groove 34, the engagement groove 35 having an inner surface which can engage the engagement projection 30 of the lever 22 so as to serve as a supporting point. The plurality of connection terminals 36 project upwardly from an inner bottom surface of the hood portion 32.

The construction of the lever fitting-type connector of this embodiment has been described above, and next, the operation and effects thereof will be described with reference to FIGS. 3 to 5.

Figure 3:
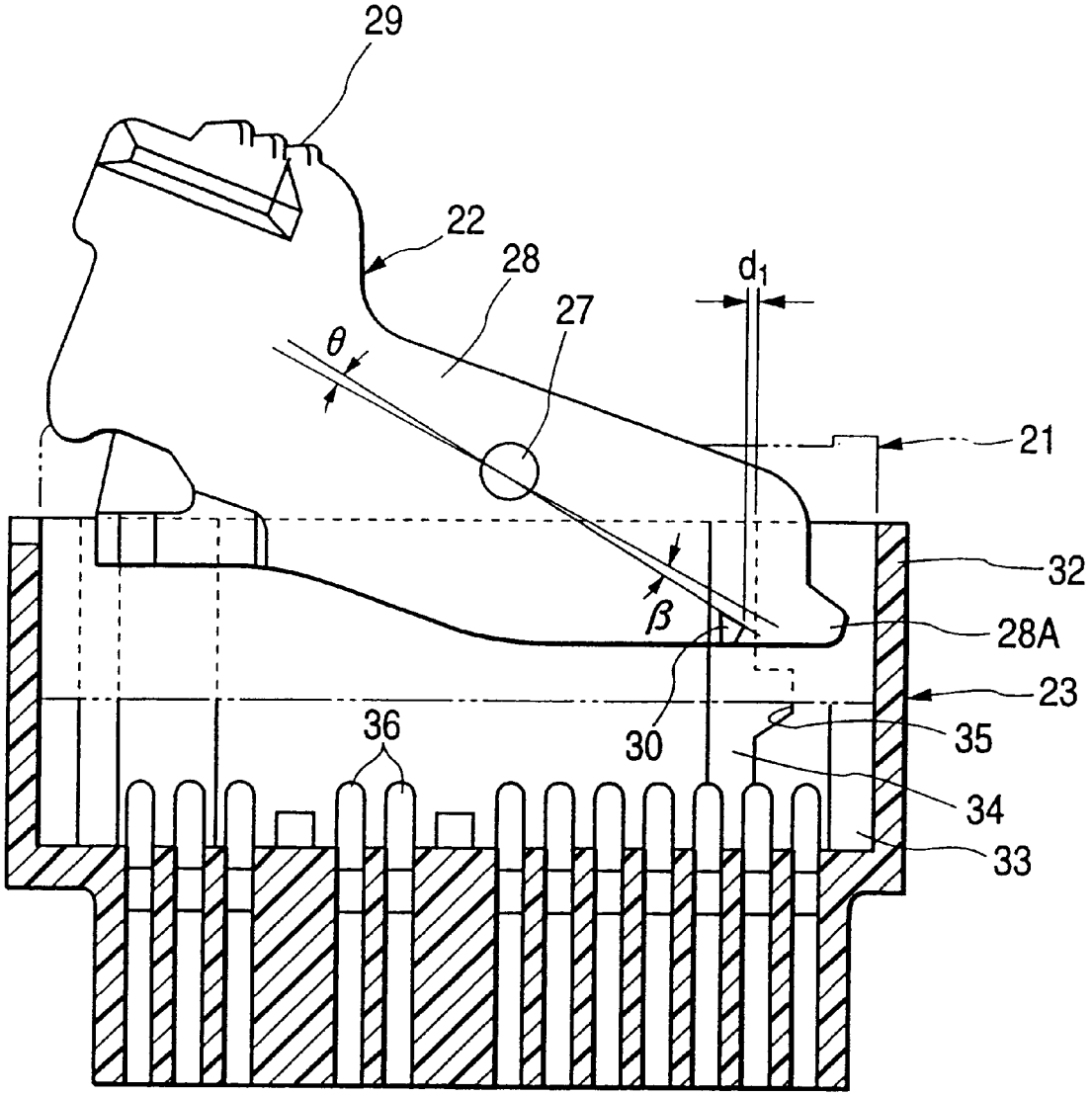
FIG. 3 is a partly cross-sectional, side-elevational view of the above embodiment, showing a condition in which the connectors are half fitted together.
Figure 4:
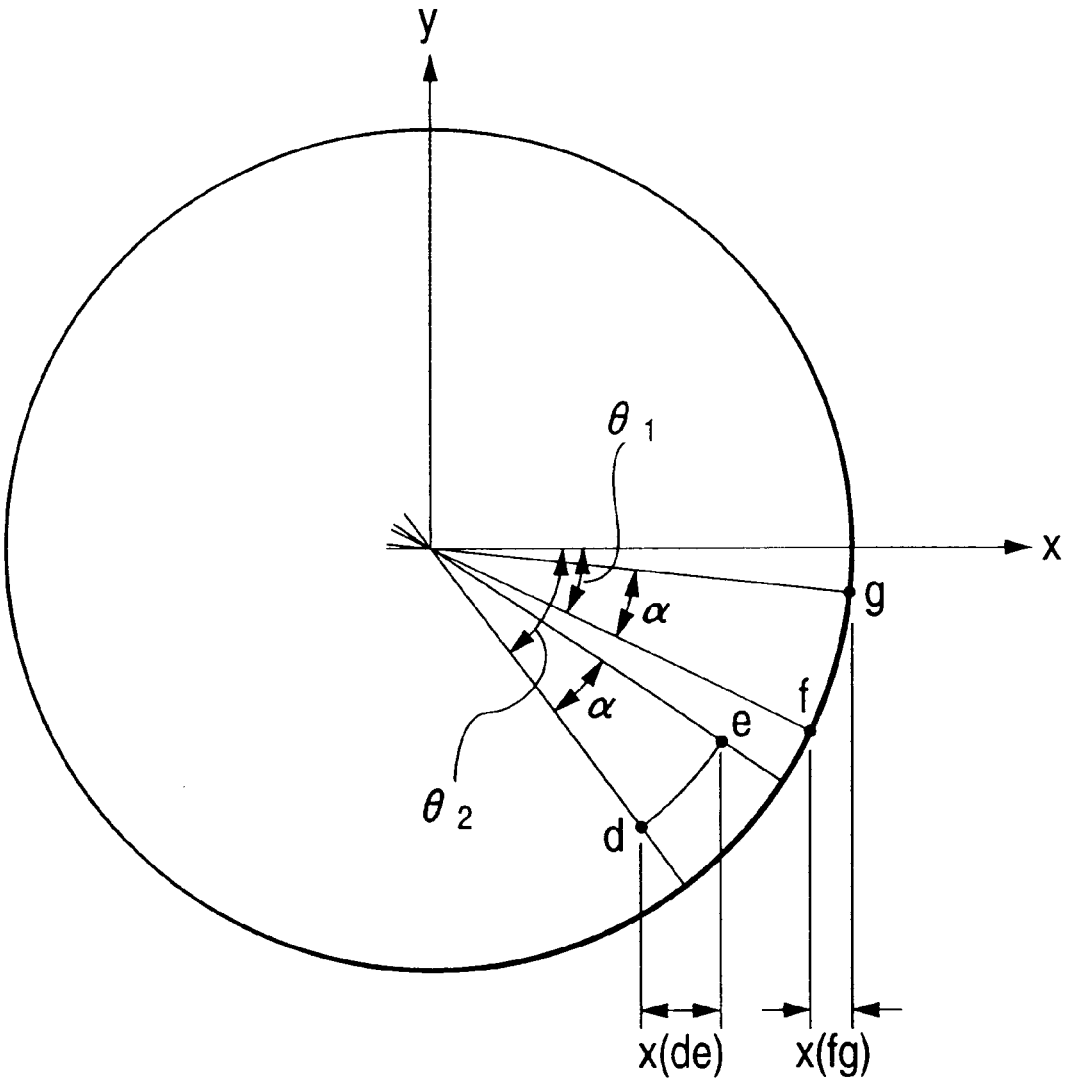
FIG. 4 is an illustration showing the amount of movement of relevant portions of the above embodiment.

As shown in FIG. 3, the male connector 21 is half fitted in the hood portion 32, and in this condition even if the lever 22 is pivotally moved slightly through an angle $\beta$ in a counterclockwise direction, each engagement projection 30 soon abuts against the front edge of the associated guide groove 34, thereby preventing the pivotal movement of the lever 22. As shown in FIG. 2, the engagement projection 30 is angularly spaced clockwise a predetermined angle ($\theta 2-\theta 1$) from the projected portion 28A about the boss 27 of the lever 22. Although the distance between the boss 27 and the engagement projection 30 is shorter than the distance between the boss 27 and the projected portion 28A, the amount x(de) of movement of the engagement projection 30 in a horizontal direction in accordance with the pivotal movement through a predetermined angle $\alpha$ is larger than the amount x(fg) of movement of the projected portion 28A in a horizontal direction through the predetermined angle $\alpha$, as shown in FIG. 4. Therefore, as shown in FIG. 3, the engagement projection 30 is positively brought into abutting engagement with the front edge of the guide groove 34 upon pivotal movement through the small rotation angle $\beta$ (that is, upon movement a distance D1), thereby preventing the pivotal movement of the lever 22.

Figure 5:
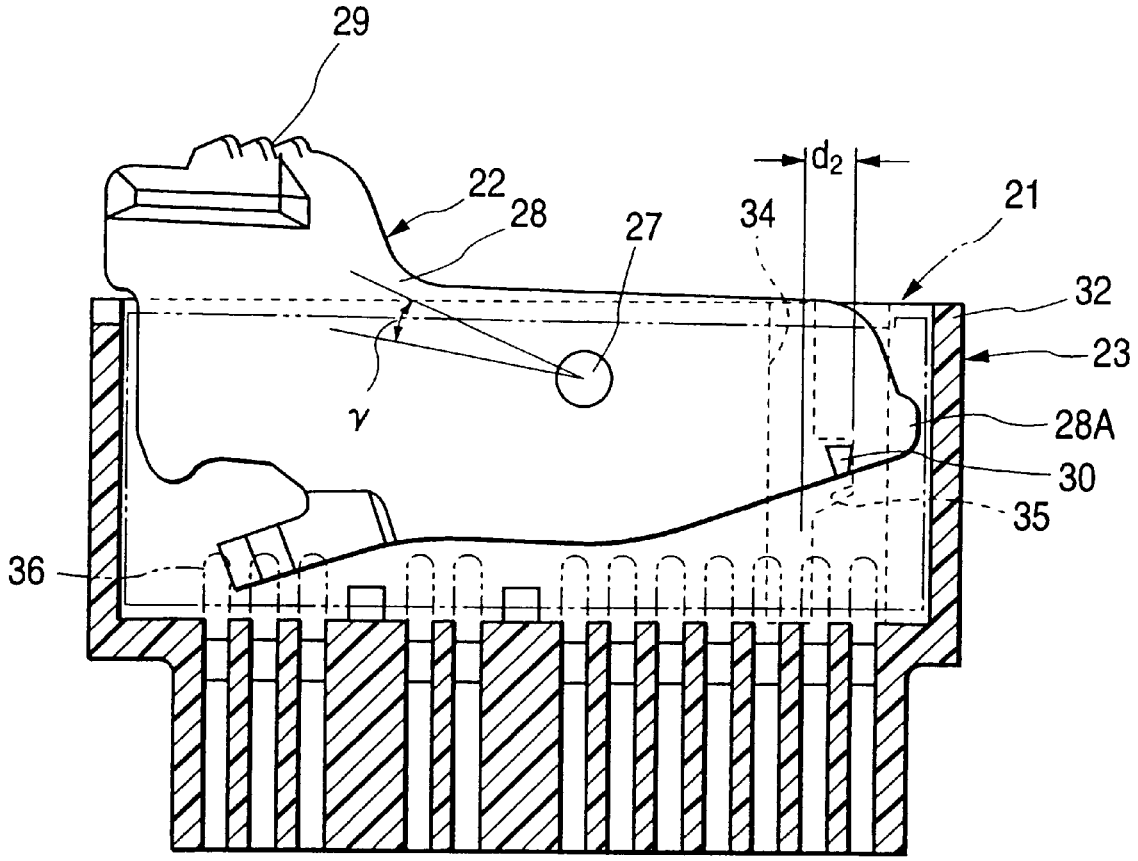
FIG. 5 is a partly cross-sectional, side-elevational view of the above embodiment, showing a condition in which the connectors are fitted together.
Figure 6:
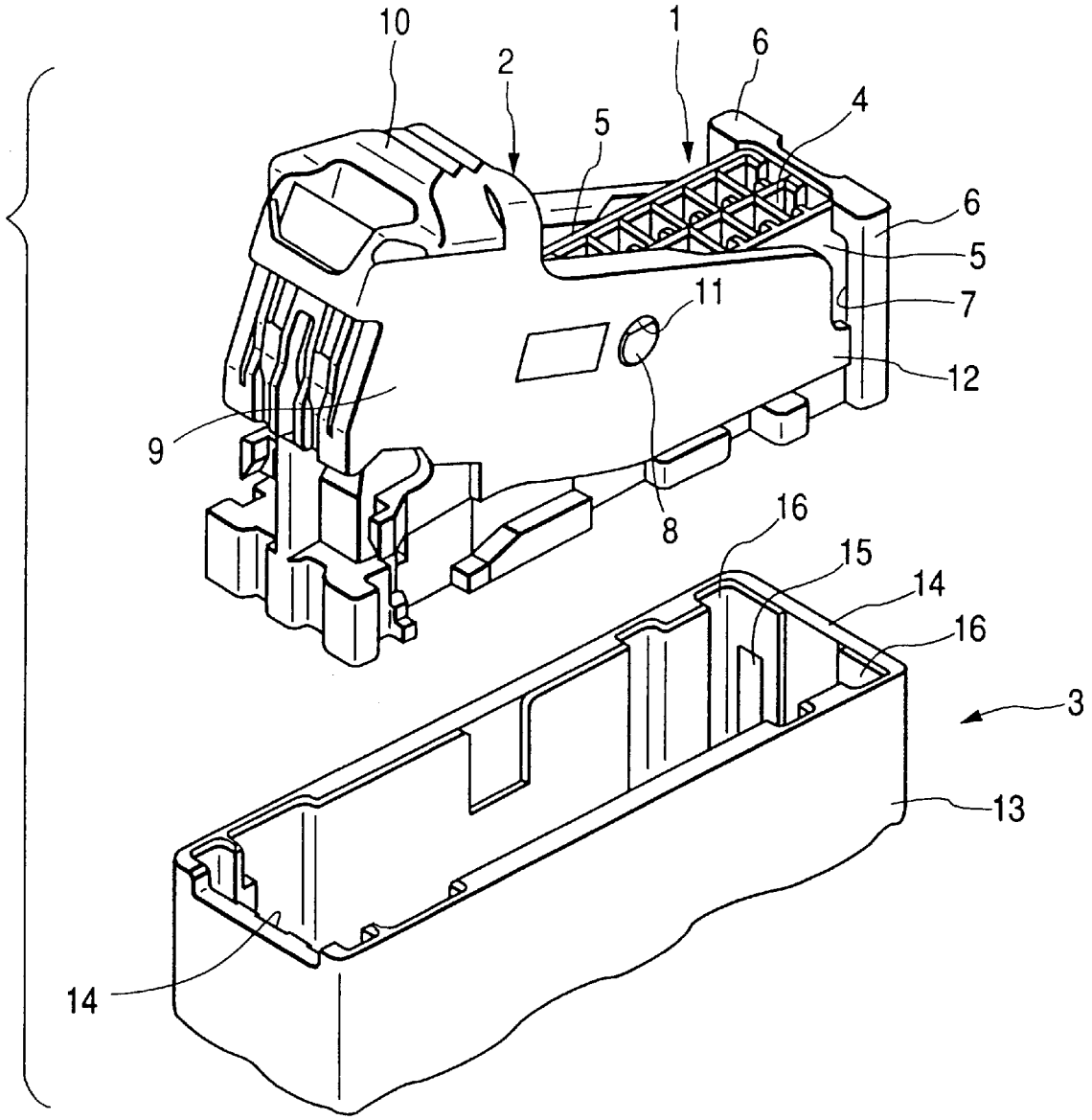
FIG. 6 PRIOR ART
FIG. 6 is an exploded, perspective view of a conventional lever fitting-type connector.
Figure 7:
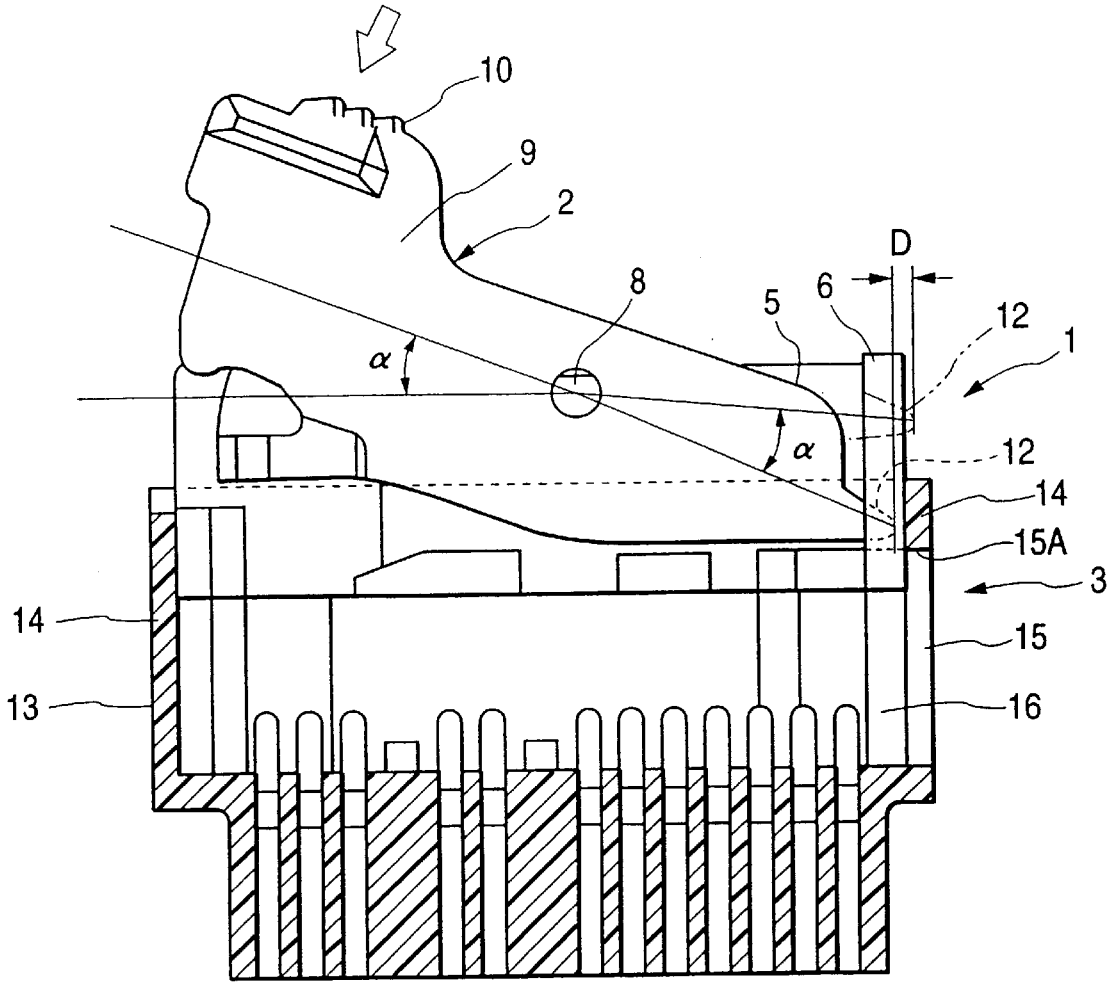
FIG. 7 PRIOR ART
FIG. 7 is a partly cross-sectional, side-elevational view showing a condition before connectors of the above conventional construction are half fitted together.

FIG. 5 shows a condition in which the male connector 21 is completely fitted in the hood portion 32 of the female connector 23. In this condition, the engagement projection 30 has moved a distance d2 from its initial position to reach the foremost portion of the engagement groove 35. In this condition, since the amount of movement of the projected portion 28A in the horizontal direction is small as described above for FIG. 4, the projected portion 28A will not project forwardly from the slot 26A in the disengagement prevention rib 26, and hence will not abut against the inner surface of the hood portion 32, as shown in FIG. 5. In this condition, the connection terminal 36 in the female connector 23 are respectively inserted into and connected to the terminals in the male connector 21 from the lower side.

The preferred embodiment has been described above, but the present invention is not limited to this embodiment, and various design changes can be made without departing from the subject matter of the invention. For example, in the above embodiment, although the projected portions 28A, formed at the front end of the lever 22, are received respectively in the slots in the disengagement prevention ribs 26, the provision of the disengagement prevention ribs 26 may be omitted in so far as the lever 22 is prevented from being disengaged from the bosses 27. The engagement projection 30 can be formed on such an area of the side wall 28 of the lever 22 that the amount of movement of the engagement projection 30 in the horizontal direction in accordance with the pivotal movement of the lever 22 is larger than the amount of movement of the projected portion 28A of the lever 22 in the horizontal direction.

As is clear from the above description, in the present invention, the inner surface of the guide groove prevents the movement of the engagement projection since the amount of movement of the engagement projection in the horizontal direction (that is, the engagement amount) is large. Namely, in a half-fitted condition of the connectors, even if the lever is operated to be pivotally moved, an uninterrupted movement of the lever will not occur, and the operating portion of the lever can not be pressed further, and therefore there is achieved an advantage that the operator can easily recognize such a half-fitted condition.

In the present invention, there is achieved an advantage that because of this principle, the connector can be easily fitted into the mating connector with a smaller force.

What is claimed is:

1. A lever fitting-type connector comprising:

a lever is pivotally supported on a connector intermediate opposite ends thereof;

an operating portion, formed at one end portion of said lever, pressed to pivotally move said lever while using said pivotally-supporting portion as an application point so as to fit said connector generally vertically into a mating connector;

a guide projection formed on said connector;

engagement projections are formed on and project laterally from opposite side surfaces of said lever, respectively, and each of said engagement projections is formed on such an area of the associated side surface of said lever that the amount of movement of said engagement projection in a generally-horizontal direction in accordance with the pivotal movement of said lever is larger than the amount of movement of the other end of said lever in a generally-horizontal direction;

guide grooves for respectively fitting on said engagement projections so as to guide them in a generally-vertical direction, said guide grooves being formed respectively in opposite inner surfaces of said mating connector; and engagement grooves formed respectively in the opposite inner surfaces of said mating connector, and communicating directly with said guide grooves, respectively, and each of said engagement grooves having an engagement surface with which the associated engagement projection is brought into sliding engagement when fitting said connector into said mating connector by pivotally moving said lever, so that said engagement surface serves as a supporting point;

wherein said guide projection communicates directly with one of said guide grooves.

2. A lever fitting-type connector according to claim 1, in which the distance between said engagement projection and said pivotally-supporting portion is shorter than the distance between said pivotally-supporting portion and said operating portion.

* * * * *